US006826466B2

(12) United States Patent
Rowlands et al.

(10) Patent No.: US 6,826,466 B2
(45) Date of Patent: Nov. 30, 2004

(54) DRAGLINE DUMP POSITION CONTROL

(75) Inventors: Jeffrey C. Rowlands, Brisbane (AU); Gregory M. Sheppard, Brisbane (AU); Andrew M. Jessett, Brisbane (AU)

(73) Assignee: CMTE Development Limited, Pinjarra Hills (AU)

( * ) Notice: Subject to any disclaimer, the term of this patent is extended or adjusted under 35 U.S.C. 154(b) by 0 days.

(21) Appl. No.: 10/361,127

(22) Filed: Feb. 5, 2003

(65) Prior Publication Data

US 2003/0191570 A1 Oct. 9, 2003

(30) Foreign Application Priority Data

Feb. 8, 2002 (AU) ..... PS0408

(51) Int. Cl.[7] ..... G06F 19/00; E02F 3/48

(52) U.S. Cl. ..... 701/50; 701/1; 37/394; 37/396

(58) Field of Search ..... 701/50, 1; 37/394–399

(56) References Cited

U.S. PATENT DOCUMENTS

| | | | | |
|---|---|---|---|---|
| 860,102 | A | 7/1907 | Newman | 37/396 |
| 887,990 | A | 5/1908 | Weeks | 37/401 |
| 945,547 | A | 1/1910 | Jones et al. | 414/645 |
| 976,163 | A | 11/1910 | Glaze | 37/401 |
| 1,093,887 | A | 4/1914 | Shnable | 37/396 |
| 1,095,335 | A | 5/1914 | Little | 37/395 |
| 1,097,029 | A | 5/1914 | King et al. | 37/396 |
| 1,135,928 | A | 4/1915 | Roys | 37/396 |
| 1,159,803 | A | 11/1915 | Sauerman | 37/401 |
| 1,228,554 | A | 6/1917 | Hanot | 37/401 |
| 1,236,691 | A | 8/1917 | Dunlop | 37/395 |
| 1,242,320 | A | 10/1917 | Burkett | 37/396 |
| 1,263,749 | A | 4/1918 | Dierks | 37/401 |
| 1,289,395 | A | 12/1918 | Clutter | 414/597 |

(List continued on next page.)

FOREIGN PATENT DOCUMENTS

| | | |
|---|---|---|
| AU | A-34502/89 | 6/1988 |
| SU | 606945 | 4/1978 |
| SU | 972008 | 11/1982 |
| SU | 1247471 | 7/1986 |
| SU | 1283303 | 1/1987 |
| WO | WO 85/04916 | 11/1985 |

OTHER PUBLICATIONS

International Search Report dated Jan. 10, 2001, International Application No. PCT/AU00/01336, filed Nov. 3, 1999.

International Preliminary Examination Report dated Sep. 21, 2001, Internatioanal Application No. PCT/AU00/01336 filed Nov. 3, 1999.

International Search Report dated Jan. 10, 2001, International Appln. No. PCT/AU00/01336, filed Nov. 3, 1999.

ESCO Production Master Dragline Buckets, Orientation Manual for Dragline Operators, 13 pgs., Aug. 1993.

*Primary Examiner*—Tan Q. Nguyen
(74) *Attorney, Agent, or Firm*—Nixon & Vanderhye P.C.

(57) ABSTRACT

A method of controlling the dump position of a dragline (1) of the type where inclination of the bucket (4) is controlled by differential control of the front hoist rope (7) and the rear hoist rope (8), in order to control dumping too close to the dragline house (2) in a position where the bucket will not release all the load and where slackness in the front hoist rope can cause fouling and serious damage. The complex locus of rear hitch positions (14) that will result in an acceptable dump angle at the bucket when dumped, is empirically transposed to a locus of rear hitch positions (15) at a typical carry angle before dumping, which is in turn approximated by a vertical cylindrical envelope (16). Calculation of when the rear hitch position (13) reaches the envelope (16) may be easily performed by a computer in real time using available parameters such as rear rope inclination and payout values.

9 Claims, 5 Drawing Sheets

U.S. PATENT DOCUMENTS

| | | | | | |
|---|---|---|---|---|---|
| 1,313,911 | A | | 8/1919 | Potter | 37/396 |
| 1,314,700 | A | | 9/1919 | Potter | 37/401 |
| 1,370,566 | A | | 3/1921 | Thompson | 37/396 |
| 1,406,725 | A | | 2/1922 | Crawford | 212/92 |
| 1,420,733 | A | | 6/1922 | Mundy et al. | 37/395 |
| 1,589,907 | A | | 6/1926 | Smith | 37/401 |
| 1,804,175 | A | | 5/1931 | Massey | 37/401 |
| 1,999,681 | A | | 4/1935 | Bakker | 37/394 |
| 2,120,444 | A | | 6/1938 | Smith | 37/341 |
| 2,152,907 | A | | 4/1939 | Miller | 37/401 |
| 2,158,061 | A | | 5/1939 | Atkins et al. | 37/396 |
| 2,947,096 | A | | 8/1960 | Cummings et al. | 37/403 |
| 2,952,083 | A | | 9/1960 | Forkner | 37/341 |
| 3,909,961 | A | * | 10/1975 | Lamer et al. | 37/397 |
| 4,035,621 | A | | 7/1977 | Kemp | 701/35 |
| 4,035,936 | A | | 7/1977 | Avara | 37/396 |
| 4,370,713 | A | | 1/1983 | McCoy, Jr. et al. | 701/50 |
| 4,527,639 | A | | 7/1985 | Dickinson, III et al. | 175/61 |
| 4,791,738 | A | | 12/1988 | Briscoe | 37/399 |
| 5,084,990 | A | | 2/1992 | Briscoe | 37/398 |
| 5,140,761 | A | | 8/1992 | Coffman et al. | 37/396 |
| 5,400,530 | A | | 3/1995 | Schmidt | 37/399 |
| 5,575,092 | A | | 11/1996 | Smit | 37/398 |
| D392,983 | S | | 3/1998 | Watts | D15/32 |
| 5,992,061 | A | | 11/1999 | Fleck et al. | 37/397 |
| 6,446,366 | B1 | | 9/2002 | Briscoe et al. | 37/398 |
| 6,550,163 | B2 | | 4/2003 | Briscoe et al. | 37/398 |
| 6,588,126 | B2 | * | 7/2003 | Leslie et al. | 37/394 |
| 2003/0126771 | A1 | | 7/2003 | Briscoe et al. | 37/398 |

* cited by examiner

DRAGLINE DUMP POSITION CONTROL

CROSS REFERENCE TO RELATED APPLICATION

"Priority is hereby claimed under 35 U.S. C. § 119 to Australian Patent Application No. PS0408, filed Feb. 8, 2002, which is incorporated by reference in its entirety."

FIELD OF THE INVENTION

This invention relates to dragline dump position control and has been devised particularly though not solely to control the dumping position for a dragline that uses a differential hoist rope control for carry angle alteration.

BACKGROUND OF THE INVENTION

When operating a dragline of the type described in international patent application PCT/AU00/01336, the content of which is incorporated herein by way of cross reference, there is a problem if an attempt is made by the operator to dump a payload within the bucket close in to the drag fairleads for the drag rope in that the bucket may not be able to reach its target dump angle due to the tension in the drag rope. In extreme cases, the angle reached may be insufficient to empty the bucket and this results in excessive slack in the front hoist rope which may become fouled and/or damaged. (Throughout this specification the term "front hoist rope" is used to refer to the hoist rope attached to the front of the bucket i.e. adjacent the attachment point of the drag rope, and the term "rear hoist rope" used to refer to the rope attached to the other or rear end of the bucket). In addition, when the slack is retrieved, excessive peak loads may be imparted to the hoist system components.

In a dragline using differential hoist rope control, it is highly desirable for the relative movements of the hoist ropes and the drag rope to be computer coordinated, and therefore also desirable to be able to control the dump position of the bucket by way of the computer control in order to ensure that any attempt to dump in an excessively close position is avoided.

It has been found however that the locus of points of the rear hoist rope hitch point which defines acceptable limits for a closest approach envelope in which to dump the bucket is a complex compound curve whose shape varies depending on many factors including bucket geometry, boom geometry and angle, boom sheave separation, rope load distribution and other parameters. The locus is typically a double cusp curve due to the complex rotation and translation mechanisms that occur during dumping at different levels above or below the drag fairleads. To attempt to analyse and control this complex curve during operation of a dragline so as to provide computer imposed limits on bucket position, or warnings to the dragline operator, requires a considerable amount of computational power and the programming of complex algorithms into the computer control system. This is undesirable due to cost implications and the necessity to make the computations in real time during the operation of the dragline.

It is therefore desirable to provide an alternative method of calculating when the bucket is reaching a position which may be too close in for efficient emptying of the bucket in a simple yet effective manner which is easy to implement using existing dragline controls and equipment.

SUMMARY OF THE INVENTION

Accordingly, the present invention provides a method of controlling the dump position of a dragline of the type wherein the inclination of the bucket is controlled by the differential control of two hoist ropes attached toward the front and the rear of the bucket respectively, said method comprising the steps of determining the radius of a cylindrical envelope having an axis coincident with the axis of rotation of the dragline house about its support base, calculating when the attachment point of the rear hitch rope of the bucket reaches said envelope and providing a signal for the control of the dump mode at that position.

Preferably the step of calculating when the attachment point of the rear hitch rope to the bucket reaches tie envelope, is performed by a computer in real time during the operation of the dragline.

Preferably the computer is the same computer used to control the differential payout of the front hoist rope and the rear hoist rope.

Preferably the radius of the cylindrical envelope is determined to approximate the locus of the positions of the attachment point of the rear hitch rope to the bucket at a predetermined carry angle of the bucket that will result in a predetermined dump angle when the front hoist rope is released.

Preferably the predetermined carry angle of the bucket is approximately +20°.

Preferably the predetermined dump angle is calculated to be the angle that will result in a substantial emptying of the bucket for a particular payload.

Preferably the predetermined dump angle is approximately −40° or less.

Preferably the position of the attachment point of the rear hitch rope to the bucket is calculated using parameters from said same computer.

Preferably said parameters include rear rope inclination and rear rope payout values.

BRIEF DESCRIPTION OF THE DRAWINGS

Not withstanding any other forms that may fall within its scope, one preferred form of the invention will now be described by way of example only with reference to the accompanying drawings in which.

DETAILED DESCRIPTION OF PREFERRED EMBODIMENTS OF THE INVENTION

Figure 1:
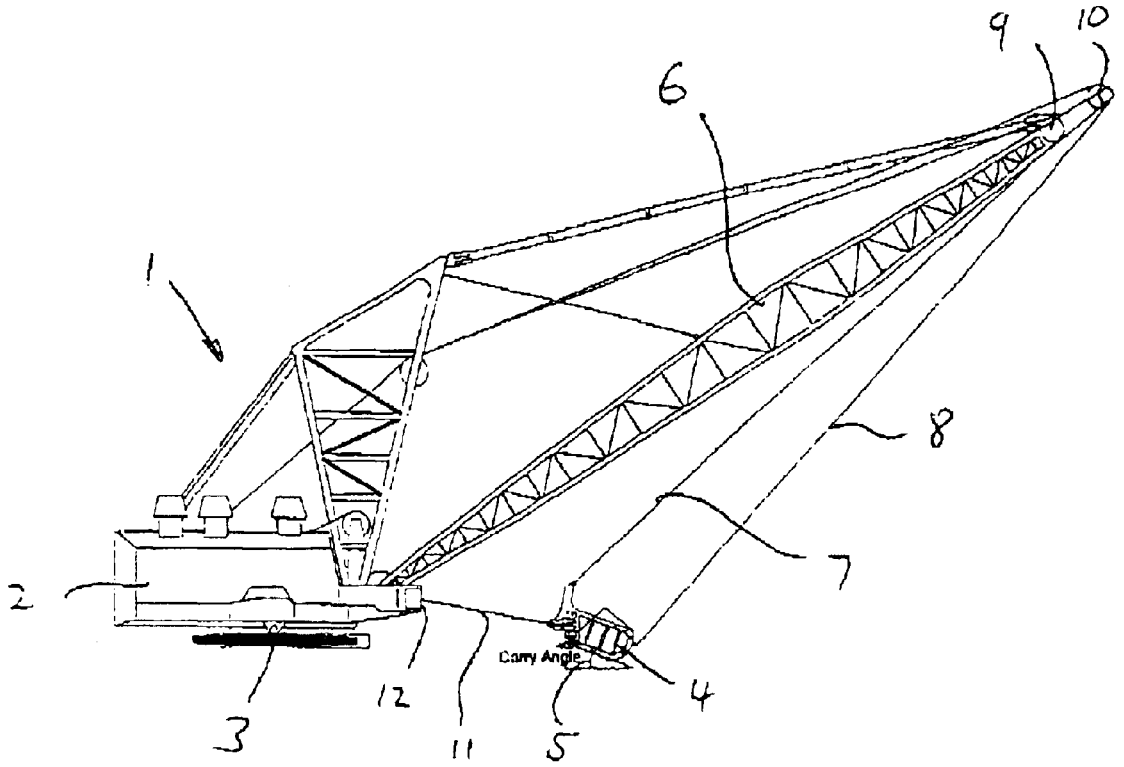
FIG. 1 is a diagrammatic side view of a dragline using differential hoist rope control with the bucket position ready to dump, close to the drag fairleads.

A dragline 1 of the type typically used in large scale mining operations has a house 2 rotatably mounted on a platform base 3 which normally comprises shoes enabling the dragline to walk backward to achieve the desired position for the operation of the bucket 4.

In draglines of the type using differential hoist rope control to alter the carry angle 5 of the bucket 4, the bucket is supported from the boom 6 by way of a front hoist rope 7 and a rear hoist rope 8 entrained around sheaves 9 and 10 respectively. The bucket is further controlled by a drag rope 11.

When a dragline of this type is operated with the bucket close in to the drag rope fairleads 12 as shown in FIG. 1, and an attempt is made to dump the payload by paying out or releasing tension on the front hoist rope 7, the bucket may not be able to reach its target dump angle, typically negative 70 degrees, due to the tension in the drag rope 11.

Figure 2:
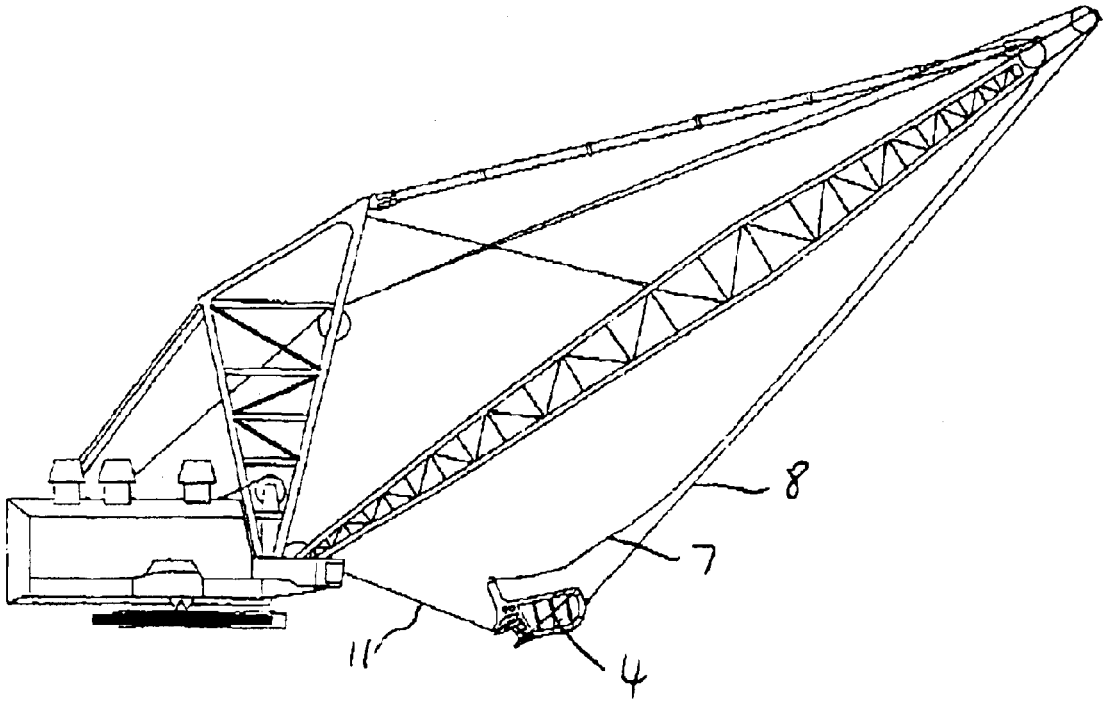
FIG. 2 is a similar view to FIG. 1 showing an attempt to dump the bucket without reaching the target dump angle.

As can be seen in FIG. 2 this results in the front hoist rope 7 becoming slack which in turn may cause the hoist rope to become fouled about sheave 9 or possibly jumping out of the hoist winch drum lagging grooves, or possibly being fouled around parts of the bucket, any of which may cause serious damage to the hoist rope and associated components. In addition, when the slack is retrieved, excessive peak loads may be imparted to the hoist system components resulting in subsequent damage or shortening of component life.

It is possible to compute a proximity position of the bucket relative to the drag rope fairleads and the boom 6 beyond which the bucket will hang up and not dump completely due to tension in the drag rope 11. Plotted as the locus of positions of the rear hitch point 13 (FIG. 3) this locus of points can be drawn as a complex double cusp curve as seen at 14 in FIG. 3. This curve is based on the assumption that the minimum angle to dump the bucket is negative 40 degrees (due to the friction angle between the bucket floor and the payload). If the bucket's rear hitch point is closer to the fairleads than the locus 14 then the achievable carry angle at dump is shallower than negative 40 degrees, and visa versa for positions further away. The locus is a complex compound curve whose shape will depend upon many factors including bucket geometry, boom geometry and angle, point sheave separation, rope load distribution etc. The double cusp of the curve is due to the complex rotation and translation mechanisms that occur during dumping at different levels above or below the drag fairleads.

Figure 3:
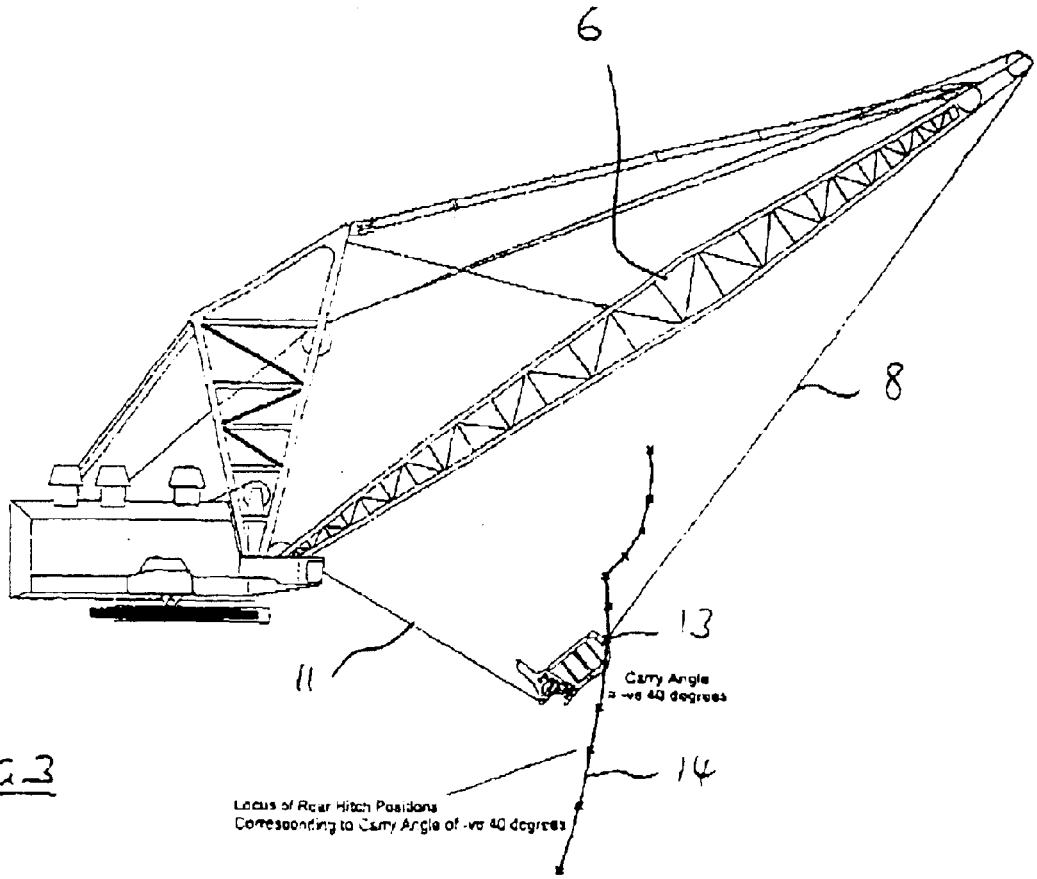
FIG. 3 is a similar view to FIG. 1 showing the locus of points of the rear hitch position beyond which it is not possible to achieve a dump angle of 40 degrees or greater.
Figure 4:
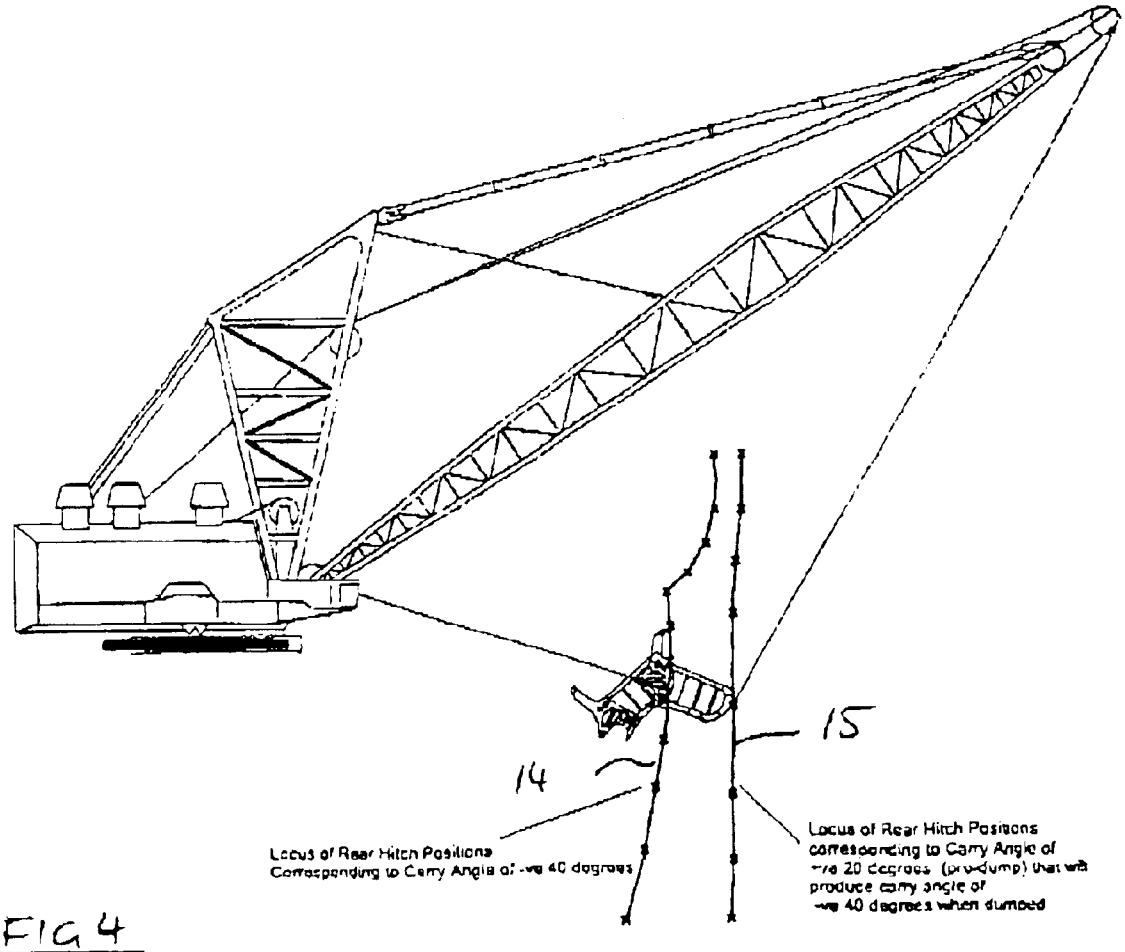
FIG. 4 is a similar view to FIG. 3 showing the locus of corresponding rear hitch positions when the bucket is in the carry mode.

It has been found in practice that it is of little use to predict the shape of the dump locus as shown in FIG. 3, because the bucket will be in carry mode just before it dumps, and therefore any system for controlling the allowable dumping position must solve the bucket geometry just before dumping commences. FIG. 4 shows the locus of points 15 that correspond to the rear hitch point when the bucket is at a carry angle of positive 20 degrees, just before dumping, that will result in the final rear hitch position reaching the locus 14. As can be seen, the shape of locus 15 is approximately a straight vertical line.

The shape of the locus 14 and the locus 15 have been obtained by empirical measurement and are extremely difficult to obtain by a mathematical algorithm, which even if it could be mapped, would require complex and extensive computer resources both in software and hardware to perform the calculation in real time necessary to control the operation of the dragline.

The present invention therefore utilises the fact that the rear hitch position just before dumping is approximately a straight vertical line (or, more realistically, a cylinder having an axis coincident with the axis of rotation of the dragline house 2 about its base 3) to provide a viable real time control mechanism for the operation of the dragline.

Figure 5:
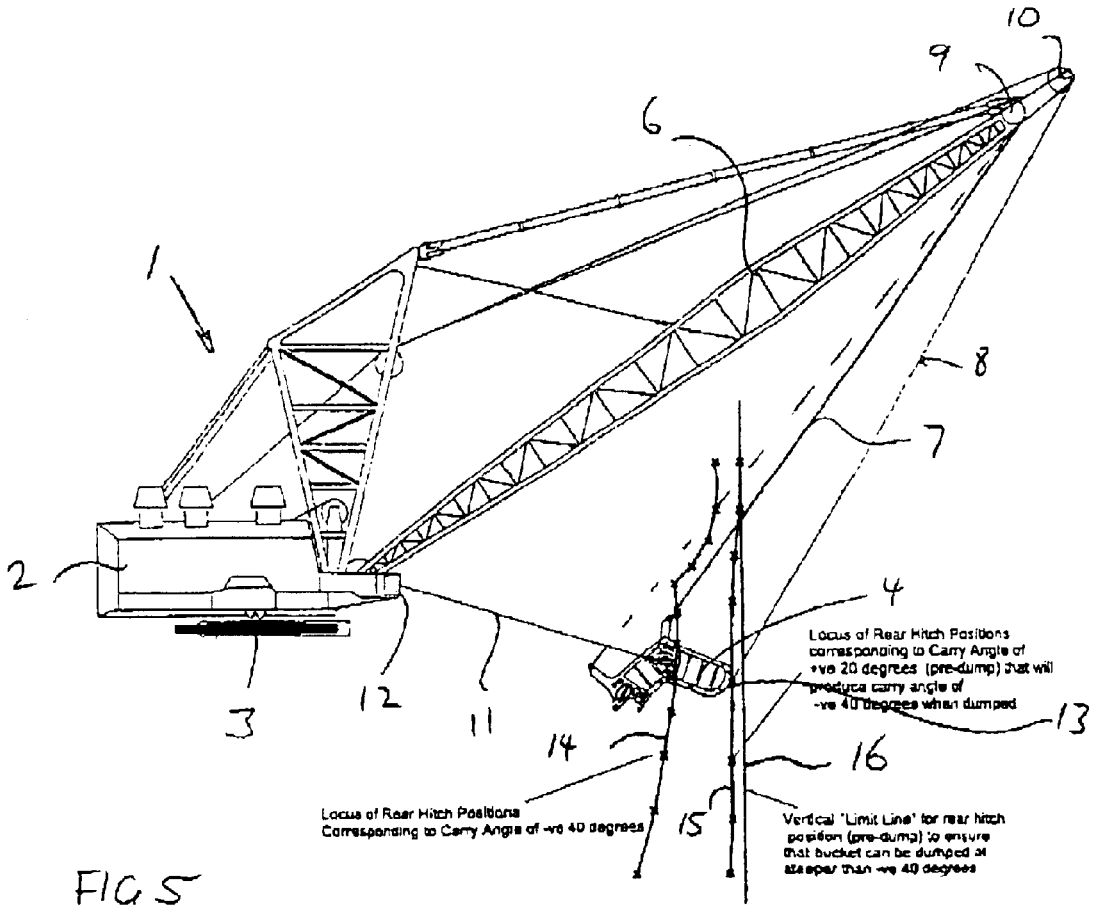
FIG. 5 is a similar view to FIG. 4 showing the imposition of a vertical or cylindrical limit envelope according to the invention.

To limit dumping to positions outside the locus 15 shown in FIG. 4, it is sufficient to approximate the locus by a vertical straight limit line 16 (FIG. 5), or in three dimensions, a cylindrical envelope. There is very little error between this line or envelope and the actual locus 15 thus maximising the maximum useful dumping span in a horizontal direction.

Consequently, it is a simple matter to program the parameters of the predetermined envelope 16 into the controlling computer for the dragline using parameters such as rear rope (8) inclination and payout values which are already operating parameters existing within the computer control. These parameters determine the locus of rear hitch positions which are acceptable for dumping and can therefore simply and quickly inhibit the operation of the dumping mode when the parameters are exceeded i.e. when the rear hitch point of the bucket moves inside the envelope 16.

It is also possible to very simply and easily provide a visual warning to the operator when the bucket has reached this position, for example by way of a visual indicator on the control panel in front of the operator so that the operator will not attempt to bring the bucket into a position where efficient dumping is not possible, so saving time and increasing the operating efficiency of the dragline.

This is particularly necessary as due to the scale of a dragline and the distances involved of the bucket from the dragline house, the operators perspective makes it difficult to judge the horizontal distance of the bucket from the operator. This is exacerbated when operating the bucket "below tub" e.g. as seen in FIG. 3, as the operator "sees" the distance of drag rope 11 that has been paid out but this may be significantly greater than the horizontal spacing between the bucket and the drag rope fairleads due to the inclination of the drag rope in the below tub position.

This method of controlling the dump position is computationally much simpler to solve than a complex analytical solution or empirical "look-up" table, and as such provides a faster and safer method for controlling the limits of dumping a dragline bucket. It also allows the useful dumping span of a dragline to be maximised in a horizontal direction.

What is claimed is:

1. A method of controlling the dump position of a dragline of the type wherein the inclination of the bucket is controlled by the differential control of two hoist ropes attached toward the front and the rear of the bucket respectively, said method comprising the steps of determining the radius of a cylindrical envelope having an axis coincident with the axis of rotation of the dragline house about its support base, calculating when the position of the attachment point of the rear hitch rope of the bucket reaches said envelope and providing a signal for the control of the dump mode at that position.

2. A method according to claim 1, wherein the step of calculating when the attachment point of the rear hitch rope to the bucket reaches the envelope, is performed by a computer in real time during the operation of the dragline.

3. A method according to claim 2, wherein the computer is the same computer used to control the differential payout of the front hoist rope and the rear hoist rope.

4. A method as claimed in claim 3 when dependent upon claim 3 wherein the position of the attachment point of the rear hitch rope to the bucket is calculated using parameters from said same computer.

5. A method as claimed in claim 4 wherein said parameters include rear rope inclination and rear rope payout values.

6. A method as claimed in claim 1 wherein the radius of the cylindrical envelope is determined to approximate the locus of the positions of the attachment point of the rear hitch rope to the bucket at a predetermined carry angle of the bucket, that will result in a predetermined dump angle when the front hoist rope is released.

7. A method as claimed in claim 6 wherein the predetermined carry angle of the bucket is approximately +20°.

8. A method as claimed in claim 6 wherein the predetermined dump angle is calculated to be the angle that will result in a substantial emptying of the bucket for a particular payload.

9. A method as claimed in claim 8 wherein the predetermined dump angle is approximately −40°.

* * * * *